US006991440B2

(12) United States Patent
Achtelik et al.

(10) Patent No.: US 6,991,440 B2
(45) Date of Patent: Jan. 31, 2006

(54) TWO-STAGE SCREW COMPRESSOR

(75) Inventors: Carsten Achtelik, Dinslaken (DE); Dieter Hüttermann, Hunxe (DE)

(73) Assignee: GHH-Rand Schraubenkompressoren GmbH, (DE)

( * ) Notice: Subject to any disclaimer, the term of this patent is extended or adjusted under 35 U.S.C. 154(b) by 0 days.

(21) Appl. No.: 10/675,315

(22) Filed: Sep. 30, 2003

(65) Prior Publication Data

US 2004/0062668 A1 Apr. 1, 2004

Related U.S. Application Data

(63) Continuation of application No. PCT/EP02/06853, filed on Jun. 20, 2002.

(30) Foreign Application Priority Data

Jun. 22, 2001 (DE) ..... 201 10 360 U

(51) Int. Cl.
*F03C 2/00* (2006.01)
*F04C 29/04* (2006.01)

(52) U.S. Cl. ..... 418/9; 418/201.1; 418/83; 418/96

(58) Field of Classification Search ..... 418/9, 418/201.1, 83, 85, 86, 99, 100
See application file for complete search history.

(56) References Cited

U.S. PATENT DOCUMENTS

| | | | | | |
|---|---|---|---|---|---|
| 3,129,877 | A | * | 4/1964 | Nilsson et al. | 418/201.1 |
| 3,265,293 | A | * | 8/1966 | Schibbye | 418/9 |
| 3,910,731 | A | * | 10/1975 | Persson et al. | 418/9 |
| 4,174,196 | A | * | 11/1979 | Mori et al. | 418/9 |
| 4,452,575 | A | * | 6/1984 | Schibbye et al. | 418/9 |
| 5,263,832 | A | | 11/1993 | Yamaguchi | |
| 5,785,149 | A | | 7/1998 | Luyts | |
| 6,506,027 | B1 | * | 1/2003 | Timuska | 417/251 |
| 6,551,082 | B2 | * | 4/2003 | Douzono et al. | 418/201.1 |

FOREIGN PATENT DOCUMENTS

| | | | | |
|---|---|---|---|---|
| DE | 69000990 | T2 | | 6/1993 |
| DE | 29922878 | U1 | | 6/2001 |
| JP | 61169688 | | | 7/1986 |
| JP | 62045992 | A | * | 2/1987 |
| JP | 02095792 | A | * | 4/1990 |
| JP | 2002168187 | A | * | 6/2002 |

* cited by examiner

*Primary Examiner*—Theresa Trieu
(74) *Attorney, Agent, or Firm*—Michael Best & Friedrich LLP

(57) ABSTRACT

A two-stage screw compressor has two compressor stages whose rotor housings are arranged with their axes parallel to one another and are enclosed by a common coolant housing at a distance. A coolant inlet and a coolant outlet are located at the common coolant housing, as well as guide walls such that the coolant flowing through the coolant housing flows around and cools the rotor housings of the two compressor stages one after the other in an S-shaped flow path.

7 Claims, 8 Drawing Sheets

TWO-STAGE SCREW COMPRESSOR

RELATED APPLICATIONS

This application is a continuation of International Application Ser. No. PCT/EP02/06853, filed Jun. 20, 2002, the entire contents of which are incorporated herein by reference.

FIELD OF THE INVENTION

This invention relates to a two-stage rotary helical screw-type compressor.

BACKGROUND OF THE INVENTION

This invention pertains to a two-stage screw compressor. A screw compressor of this type is known from DE 299 22 878 U1, among other documents. Reference is made to the disclosure of this document in its entirety.

In this prior art screw compressor, each of the two compressor stages, which jut out from the gear housing parallel to one another, is enclosed by its own coolant housing that is connected to the coolant circuit or coolant sump through its own connection. Because of the space requirements of the coolant housings of the two compressor stages mentioned, the design of this prior art screw compressor is not particularly compact.

A prior art screw compressor is known from U.S. Pat. No. 4,174,196 that has two compressor stages whose compressor housings are arranged parallel to one another and are enclosed by a common inner housing. The inner housing is enclosed by a concentric outer housing and the annulus between the inner and outer housing is subdivided into chambers through which a coolant flows in order to cool tube bundles located within the chambers through which the compressed gas flows. A first coolant stream cools the compressed gas from the first compressor stage, and a second coolant cools the compressed gas from the second compressor stage. The coolant has essentially no direct cooling effect on the rotor housings of the two compressor stages.

SUMMARY OF THE INVENTION

An objective of the invention is to provide a two-stage screw compressor of the above type having a particularly compact design and whose manufacture is simplified and herein the utilization of the cooling effect of the coolant circuit is improved.

According to the invention, the rotor housings of both compressor stages are located in a common cooling housing that encloses them at a distance, and are preferred to be manufactured in one piece together with the cooling housing. The cooling housing has only one coolant inlet and one coolant outlet and is designed such that the coolant is forced to follow a flow path that passes around and cools the two rotor housings of the compressor stages one at a time. This results in an especially compact design and at the same time a simplification in the manufacture of the screw compressor, in addition to an improved utilization of the coolant.

Another way to design the screw compressor to be particularly compact is to place the four connections of the two compressor stages (inlet and outlet of the low-pressure stage, inlet and outlet of the high-pressure stage) one at each of the four sides of the square coolant housing. The available space at each of the lateral surfaces of the coolant housing can then be optimally used for the connection located there without being hindered by another connection on the same side.

Other features and advantages of the present invention will become apparent to those skilled in the art upon review of the following detailed description and drawings.

Figure 1:
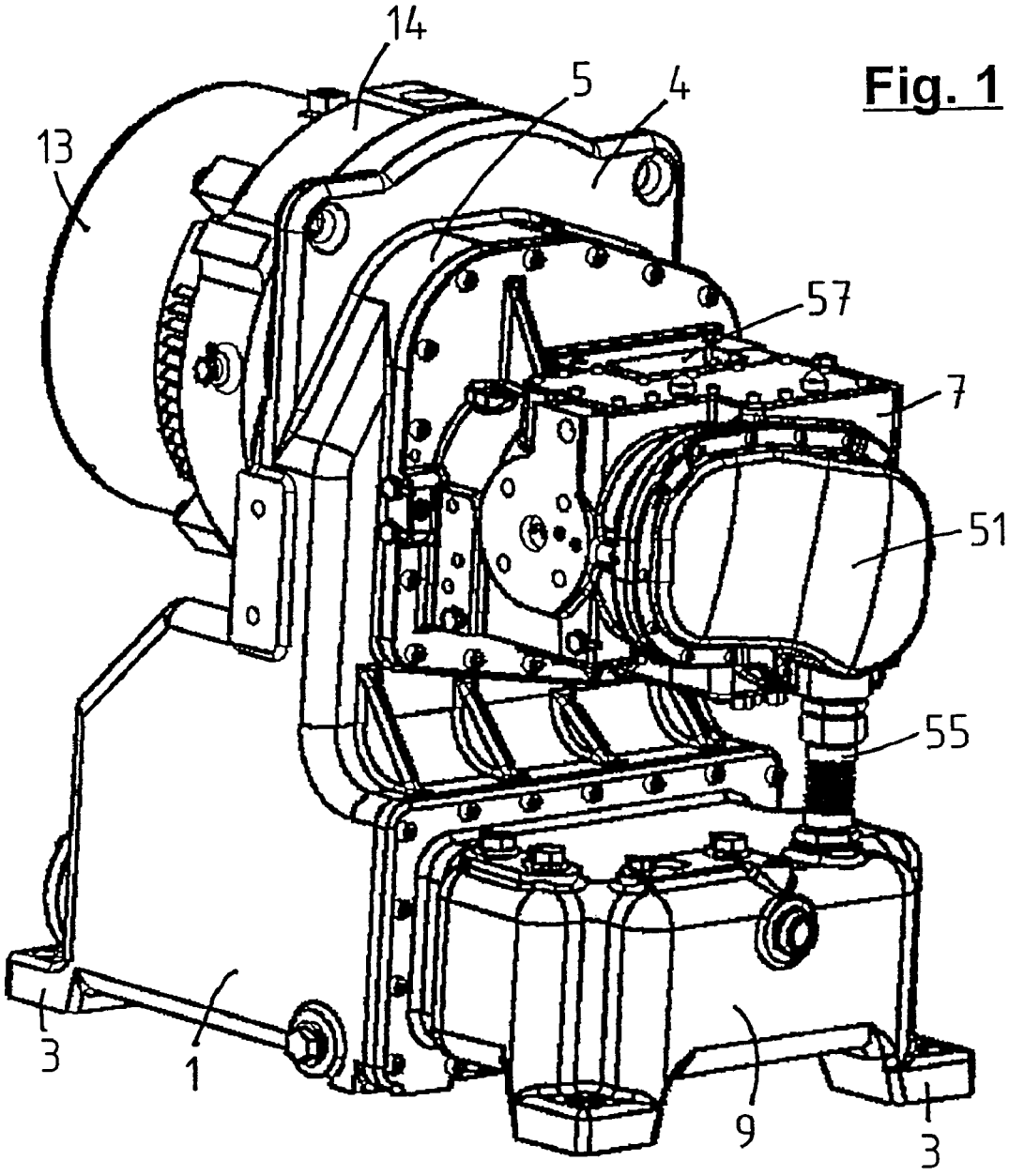
FIG. 1 is a perspective view of a screw compressor according to an embodiment of the invention.

Before the constructions of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 2:
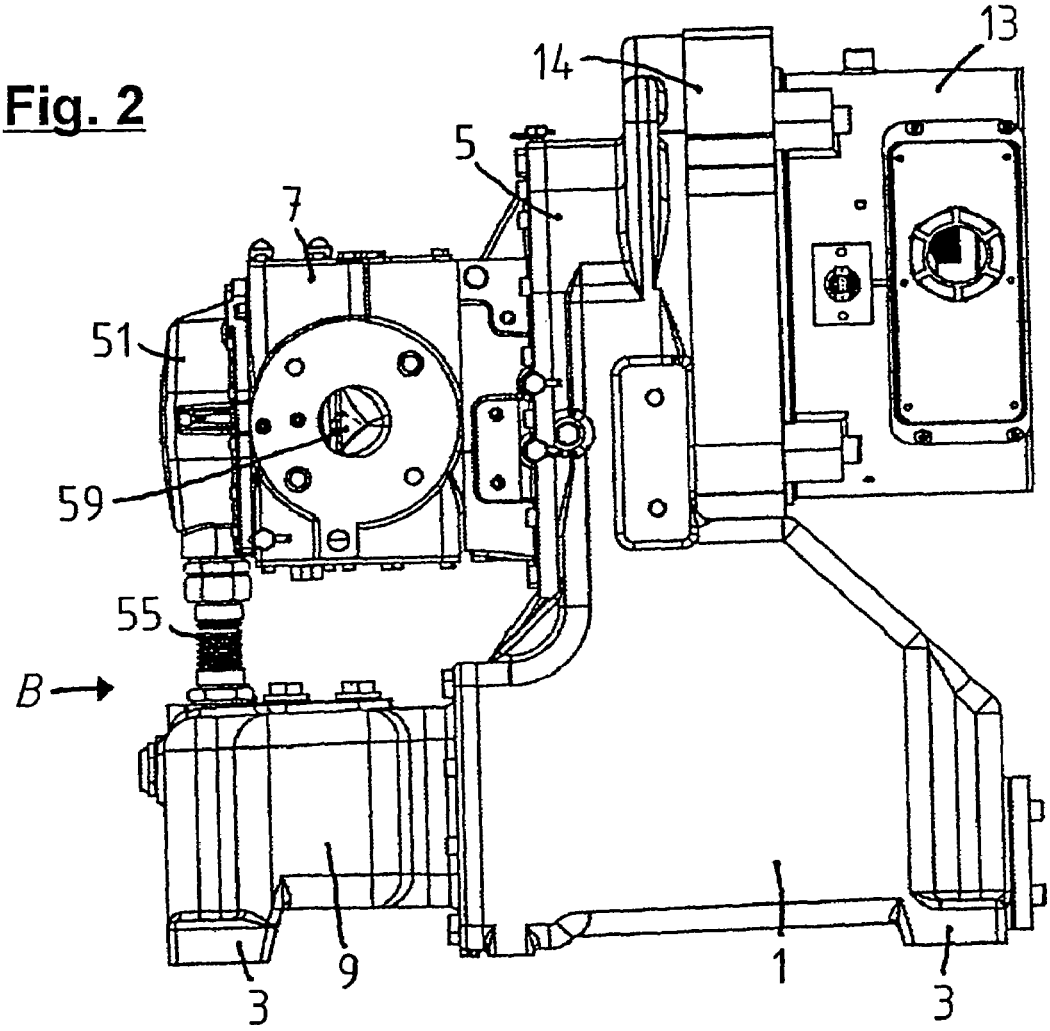
FIG. 2 is a side view of a screw compressor according to an embodiment of the invention as seen in the direction of arrow A in FIG. 3.
Figure 3:
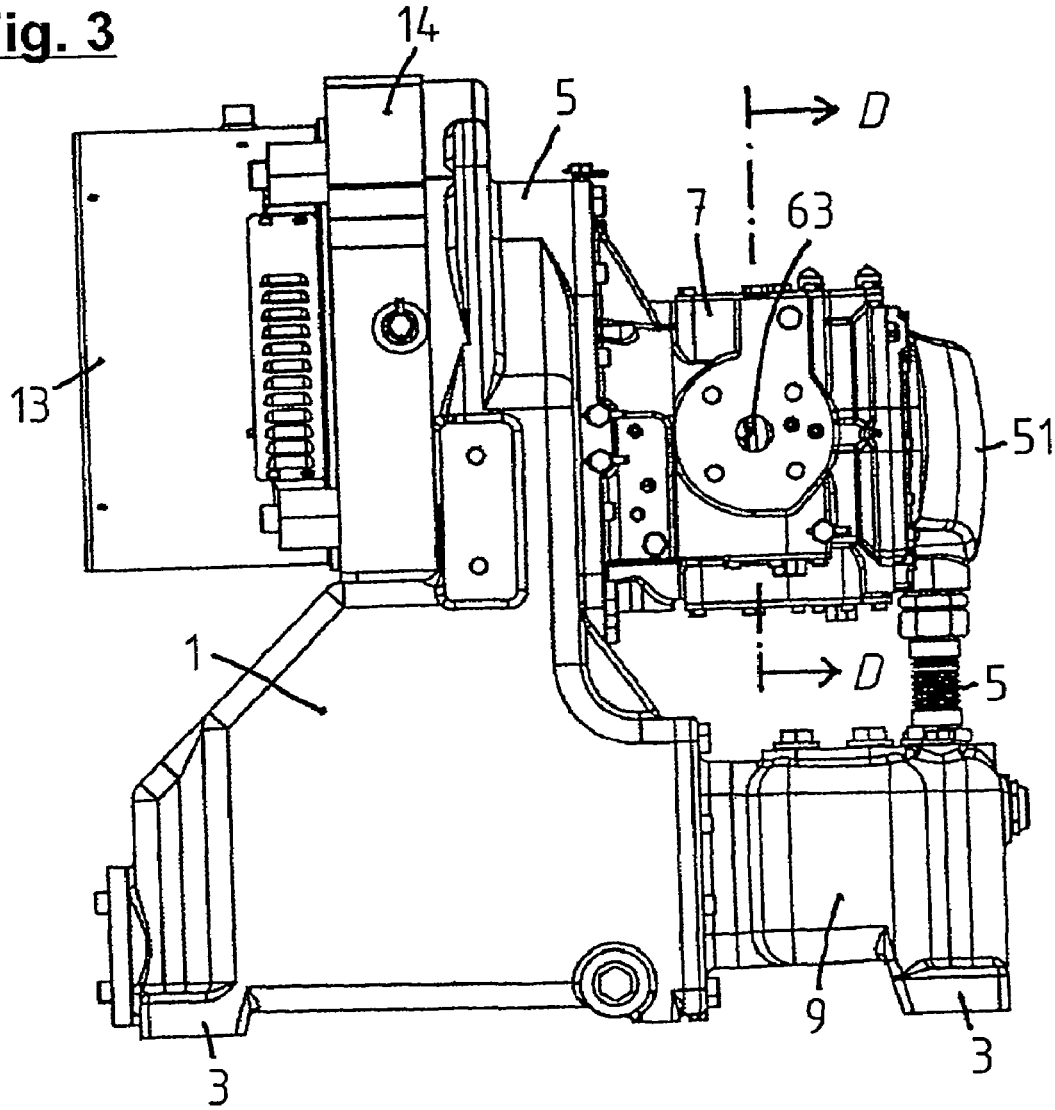
FIG. 3 is a rear view of the screw compressor as seen in the direction of arrow B of FIG. 2.
Figure 4:
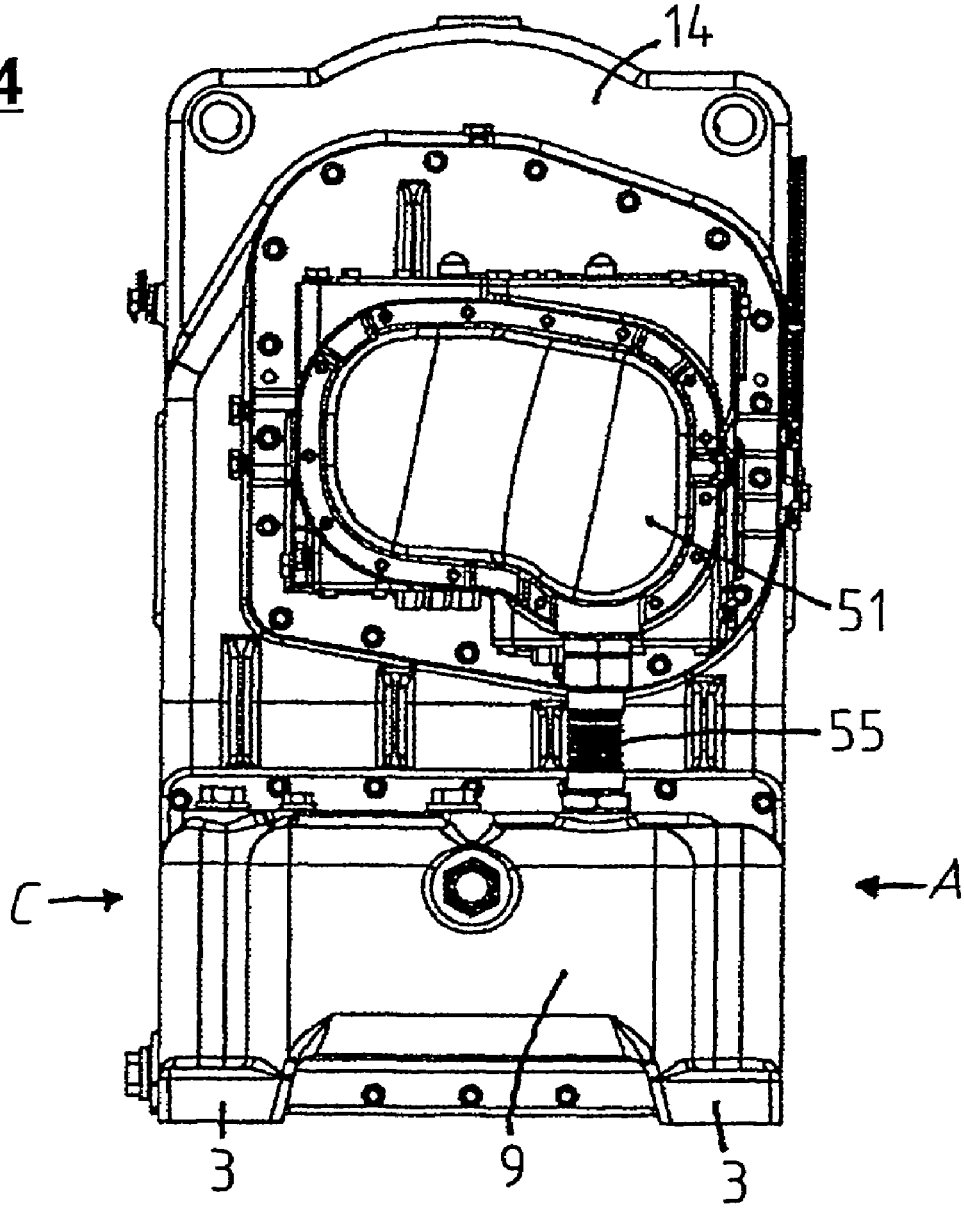
FIG. 4 is a side view as seen in the direction of arrow C in FIG. 3.
Figure 5:
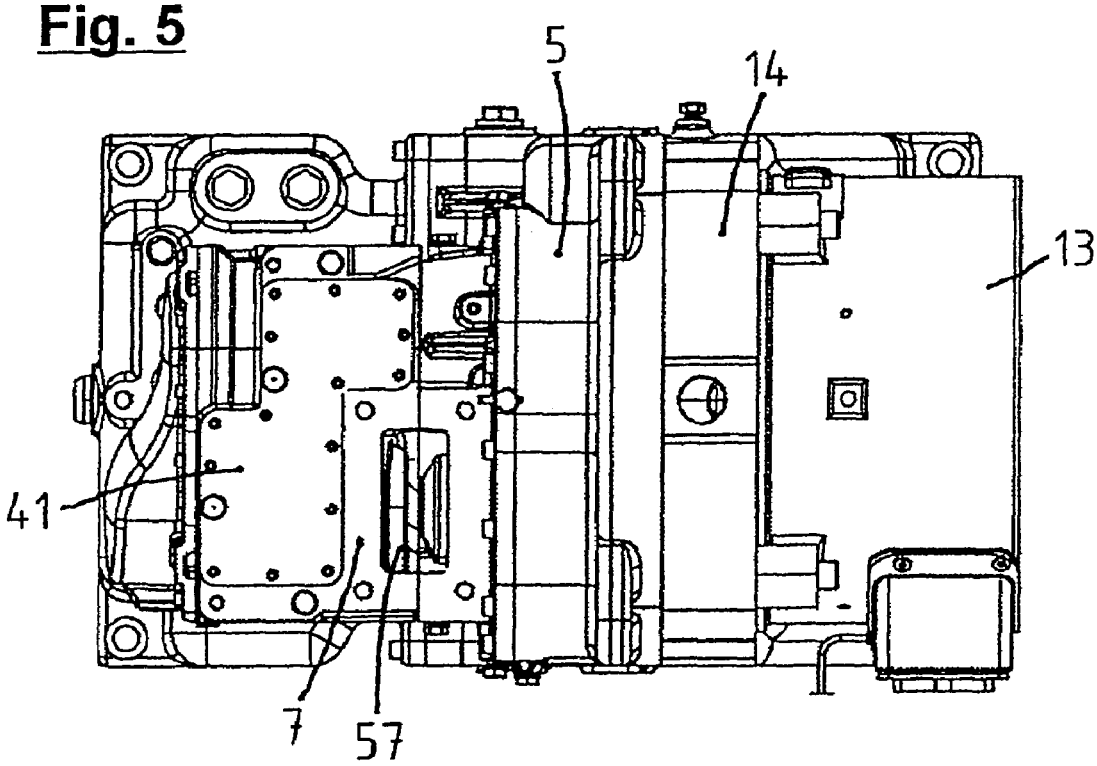
FIG. 5 is a plan view of the screw compressor according to FIG. 2.

The two-stage screw compressor shown in FIGS. 1–5 has a housing 1 that is provided with feet 3 to fasten to a base. The upper section 5 of the housing 1 has essentially the shape of a disc-shaped upright with two vertical end walls. Attached to the left end wall in FIG. 2 is a coolant housing 7 that extends out freely. The coolant housing 7 encloses two compressor stages located in its interior, each of which consists of a rotor housing inside of which two screw rotors are located that mesh with one another, as will be explained hereafter with reference to FIG. 8. An oil supply basin 9 extends out from the bottom section of the housing 1 below the coolant housing 7 at a distance from it. The oil basin also can have feet 3 to support it on the base. On the side of the upper housing section 5 opposite the coolant housing 7 is a drive unit 13 with a preferably RPM-regulated motor that drives the screw rotors of the compressor stages via a gear housed in housing section 5. The drive motor 13 can also run an oil pump that is placed in housing section 14 between the drive unit 13 and the branching gear in housing section 5.

The screw compressor illustrated is preferred to be a dry-running screw compressor, i.e. the actual compression space containing the screw rotors is kept free of oil. The oil kept in circulation by the oil pump is used on one hand to lubricate the gear and the roller bearings of the screw rotors, and on the other hand as a coolant to externally cool the rotor housings of the two compressor stages.

With respect to the details of the drive system using the RPM-regulated drive motor, the branching gear and the integration of the oil pump into the housing, an example is shown in previously mentioned DE 299 22 878 U1, the entire contents of which are incorporated herein by reference. This also applies to other advantageous features disclosed in this document that can also be applied to the screw compressor according to this invention, such as the internally integrated oil pump, which alleviates the need for a seal, the direct coupling of the motor to the drive journal of the gear without the usual coupling, which requires considerable space, as well as the design of the motor-driven gear such that an optimum effectiveness is achieved within a prescribed RPM range of the motor, for example between 2500 and 5500 RPM.

Figure 6:
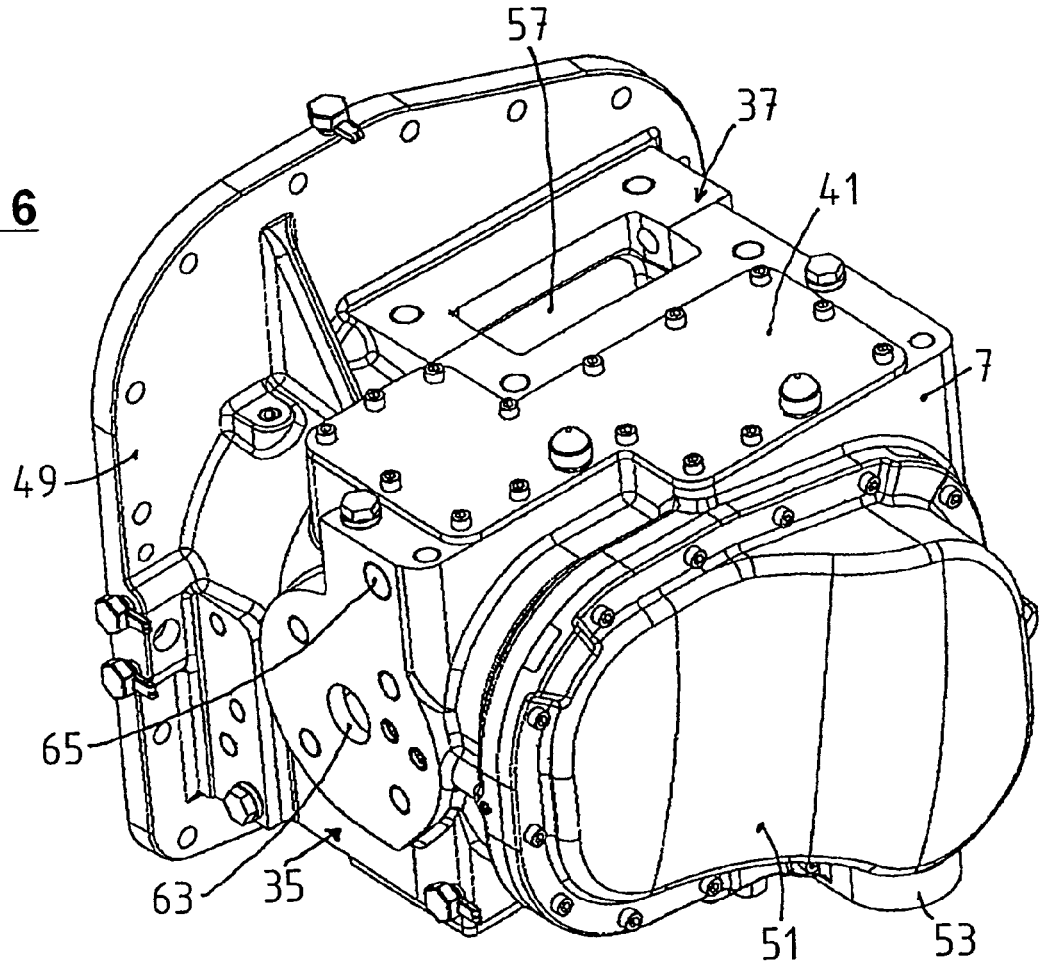
FIG. 6 is a perspective representation of the coolant housing of the screw compressor as seen from above left.
Figure 7:
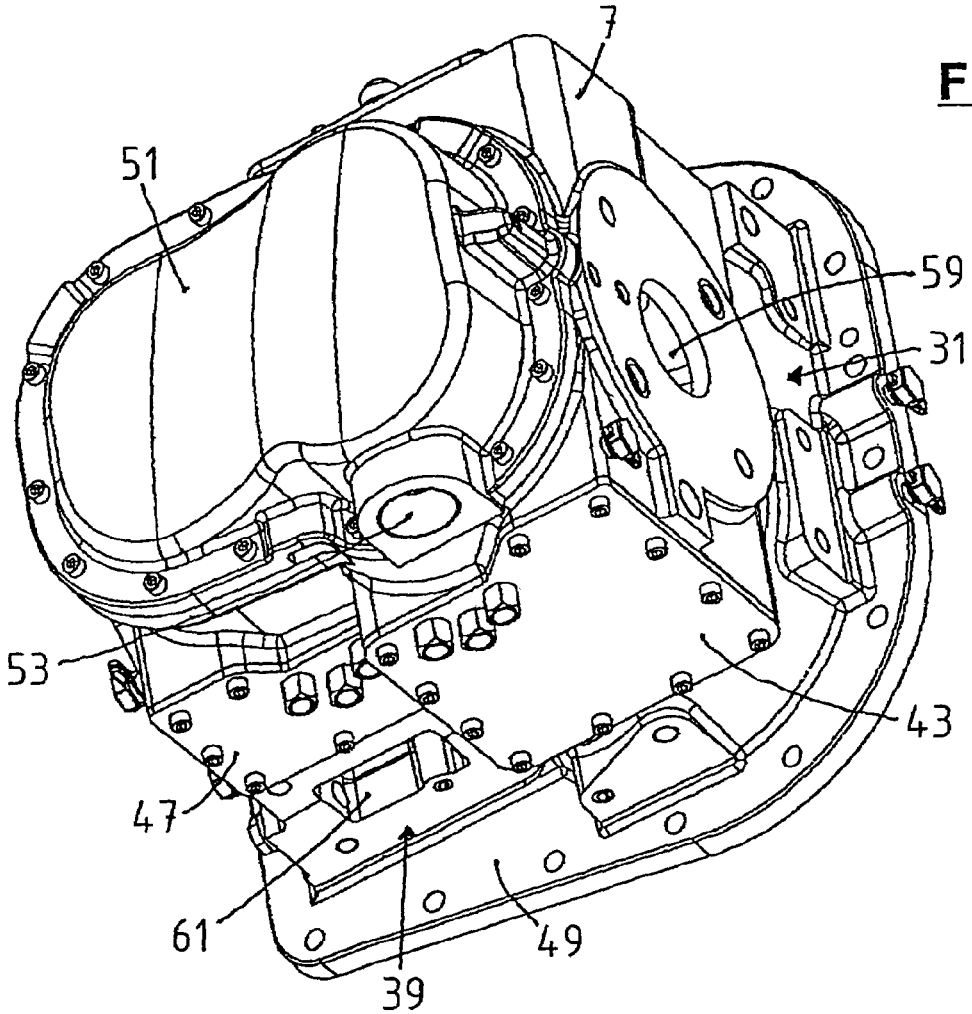
FIG. 7 is a perspective representation of the coolant housing according to FIG. 6, but as seen from below right.
Figure 8:
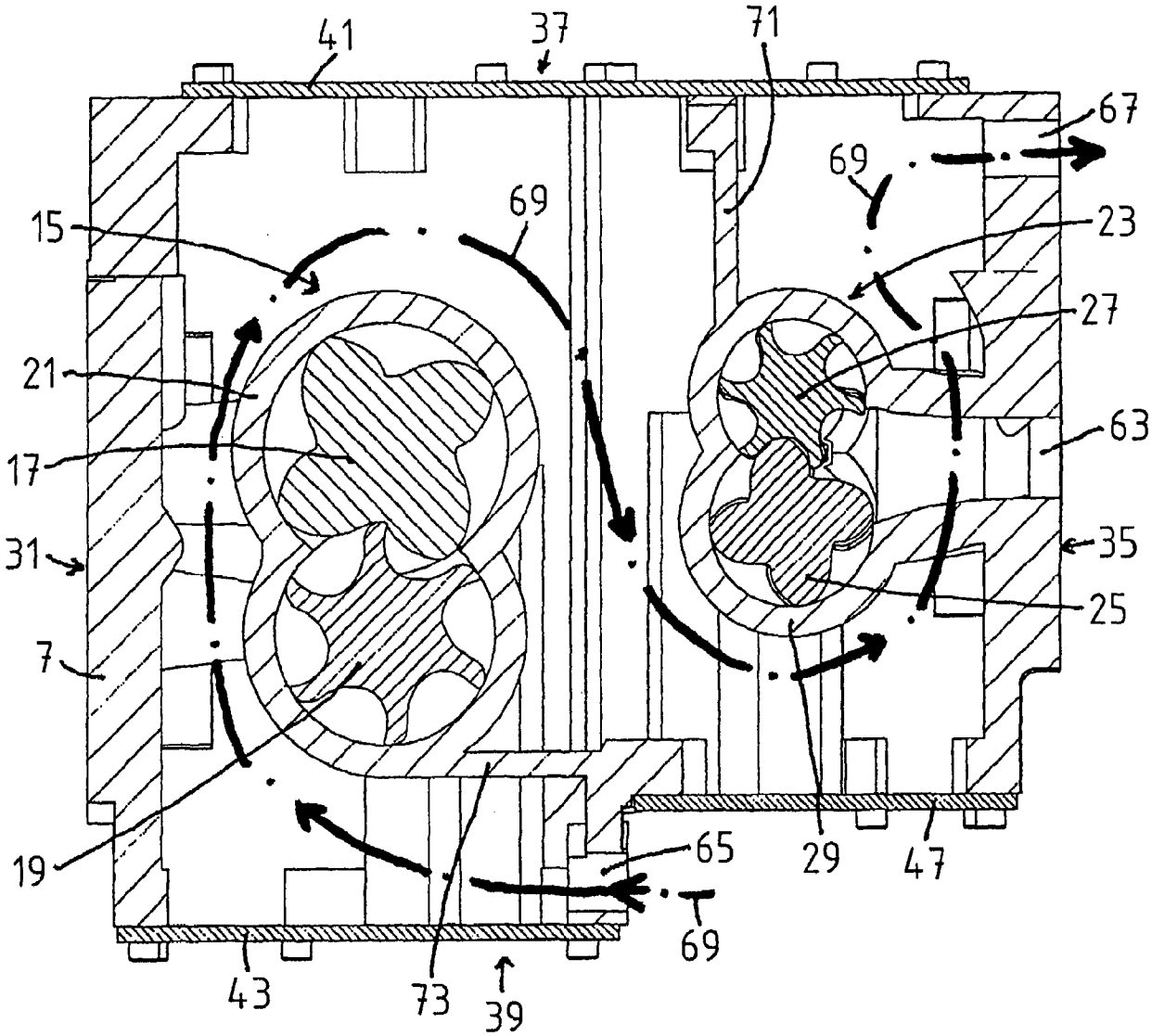
FIG. 8 is a cross section through the coolant housing and the compressor stages perpendicular to their axes, according to the section line and the view direction of arrow D—D in FIG. 4.

The part of the screw compressor to which aspects of this invention mainly refer, namely the coolant housing 7 containing the compressor stages within, is illustrated in FIGS. 6–7 in perspective views from two different directions of view and in FIG. 8 in a cross section.

According to FIG. 8, a first compressor stage 15 is located inside of the coolant housing 7 (low pressure stage) with two meshing screw rotors 17, 19 that are held in a rotor housing 21 that has a cross section in the shape of a FIG. 8, and a second compressor stage 23 (high pressure stage) is placed with its axis parallel to the first stage with a pair of screw rotors 25, 27 that are held in a FIG. 8 shaped rotor housing 29.

The coolant housing 7 is in the shape of a box with an essentially square cross section so that it has two side walls 31, 35 parallel to the rotors 17, 19, 25, 27, a top 37, and a bottom 39.

The coolant housing 7 has openings on the top and bottom that are closed off by bolted-on plates 41, 45, and 47.

At one of its ends, the coolant housing 7 transitions into a large surface flange 49 that is used to fasten the coolant housing 7 to the gear housing 5 and which has a matching exterior contour. At the other end, the coolant housing 7 is closed off by an end bearing cover 51 that is bolted to the coolant housing 7. At the bottom of the bearing cover 51 is an oil drain fitting 53 that is connected to the oil supply basin 9 via a return line 55 (FIGS. 1–5).

At the top of the coolant housing 7 is the inlet opening 57 to intake the gas to be compressed in the compression space inside the rotor housing 21 of the first compressor stage 15. The outlet 59 for the gas compressed in the first stage is located in the right side wall 31 in FIG. 7 (to the left in FIG. 8). At the bottom 39 of the coolant housing 7 is the inlet opening 61 for the second compressor stage 23 (high pressure stage). The outlet opening 63 of the second compressor stage 23 is located in the left side wall 35 in FIG. 6 (to the right in FIG. 8). The outlet opening 59 of the low-pressure stage is connected to the inlet opening 61 of the high-pressure stage in general via an intermediate cooler (not shown in the drawings). Also not shown are the filter and/or muffler installed ahead of the intake opening 57 of the low-pressure stage as well as the muffler, cooler and/or filter installed after the outlet 63 of the high-pressure stage. This equipment can be of any desired design available to one trained in the art.

In the embodiment described, the total of four connections of the two compressor stages (entrance and exit ports 57, 59 of the low pressure stage 15, entrance and exit ports 61, 63 of the high pressure stage 23) are placed one at each of the four sides 31, 35, 37, 39 of the coolant housing 7, resulting in a compact design making good use of the available space at the four sides of the housing 7.

As can be seen in FIG. 8, the rotor housings 21, 29 of the two compressor stages 15, 23 are placed at a sufficient distance from the walls of the coolant housing 7. In the intermediate space formed thereby, a cooling medium circulates to effect common cooling of the two compressor stages 23, 15. To this end, the coolant housing 7 has an inlet opening 65 at the bottom 39 for the cooling medium and an outlet opening 67 near the top of side wall 35 for the cooling medium. The coolant fed in at opening 65 flows through the coolant housing 7 and makes its way to the exits opening 67 in an S-shaped flow path that is indicated by the dot-dashed line 69. This flow path is forced to occur via guide walls 71, 73 that extend at suitable points though the intermediate space between the rotor housing 21, 29 and the coolant housing 7. The flow path 69 first flows around rotor housing 21 of the low pressure stage 15 and then around rotor housing 29 of the high pressure stage 23, each time by a "wrap-around angle" of more than 180°, preferably nearly 360°.

It is preferred that the rotor housings 21, 29 of the compressor stages, the guide walls 71, 73 and the coolant housing 7 are produced as a one-piece housing block, as indicated by the uniform hatching in FIG. 8.

The foregoing detailed description describes only a few of the many forms that the present invention can take, and should therefore be taken as illustrative rather than limiting. It is only the claims, including all equivalents that are intended to define the scope of the invention.

What is claimed is:

1. A two-stage screw compressor comprising:

two compressor stages that are parallel with respect to one another, each compressor stage having a pair of screw rotors that mesh together and are located in a respective rotor housing, and a coolant housing enclosing both of the rotor housings and having a coolant inlet a coolant outlet, and at least one guide wall, the at least one guide wall at least partially defining a coolant flow path, wherein the coolant flow path allows a coolant to flow from the coolant inlet to the coolant outlet such that coolant passes around both rotor housings and cools both rotor housings.

2. A screw compressor according to claim 1, characterized in that the coolant first passes around and cools essentially one rotor housing and then the other rotor housing along its flow path from the inlet to the outlet.

3. A screw compressor according to claim 1, characterized in that the rotor housings are designed as an integral block in one piece with at least a section of the coolant housing.

4. A two-stage screw compressor comprising two compressor stages that are parallel with respect to one another, each compressor stage having a pair of screw rotors that mesh together and are located in a respective rotor housing; a coolant housing enclosing both of the rotor housings and having a coolant inlet and a coolant outlet, designed such that a coolant that flows from the inlet to the outlet passes around and cools essentially one rotor housing and then the other rotor housing along its flow path from the inlet to the outlet; wherein the coolant first flows around the rotor housing of the first compressor stage and then the rotor housing of the second compressor stage.

5. A two-stage screw compressor comprising two compressor stages that are parallel with respect to one another, each compressor stage having a pair of screw rotors that mesh together and are located in a respective rotor housing, each of the two rotor housings being surrounded by a coolant housing and being cooled by coolant that flows inside of the coolant housing, both rotor housings being enclosed at a distance by the coolant housing and the coolant housing having a coolant inlet and a coolant outlet designed such that the coolant that flows from the inlet to the outlet passes around and cools both rotor housings, characterized in that the flow path of the coolant proceeds in an S shape first around one compressor stage and then around the other compressor stage.

6. A two-stage screw compressor comprising two compressor stages that are parallel with respect to one another, each compressor stage having a pair of screw rotors that mesh together and are located in a respective rotor housing, each of the two rotor housings being surrounded by a coolant housing and being cooled by coolant that flows inside of the coolant housing, both rotor housings being enclosed at a distance by the coolant housing and the coolant housing having a coolant inlet and a coolant outlet designed such that the coolant that flows from the inlet to the outlet passes around and cools both rotor housings, characterized in that an intermediate space between the coolant housing and the rotor housings is partitioned by means of guide walls that force the cooling medium to take the prescribed flow path.

7. A two-stage screw compressor comprising two compressor stages that are parallel with respect to one another, each compressor stage having a pair of screw rotors that mesh together and are located in a respective rotor housing, each of the two rotor housings being surrounded by a coolant housing and being cooled by coolant that flows inside of the coolant housing, both rotor housings being enclosed at a distance by the coolant housing and the coolant housing having a coolant inlet, a coolant outlet, and at least one guide wall designed such that the coolant that flows from the inlet to the outlet passes around and cools both rotor housings, characterized in that the coolant housing is designed essentially box-shaped with four sides that are parallel to the screw rotors of the compressor stages, and the compressor having four connections including a first compressor stage inlet, a first compressor stage outlet, a second compressor stage inlet and a second compressor stage outlet, one connection being located on each side of the coolant housing.

* * * * *